US009284811B2

(12) United States Patent
Michaud et al.

(10) Patent No.: US 9,284,811 B2
(45) Date of Patent: Mar. 15, 2016

(54) UNIVERSAL ROTATING FLOW HEAD HAVING A MODULAR LUBRICATED BEARING PACK

(75) Inventors: George James Michaud, Calgary (CA); Lawrence Gerald Cyr, Red Deer (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 938 days.

(21) Appl. No.: 13/378,957

(22) PCT Filed: Jun. 19, 2009

(86) PCT No.: PCT/CA2009/000835

§ 371 (c)(1), (2), (4) Date: May 8, 2012

(87) PCT Pub. No.: WO2010/144989

PCT Pub. Date: Dec. 23, 2010

(65) Prior Publication Data

US 2012/0217022 A1 Aug. 30, 2012

(51) Int. Cl.
*E21B 33/08* (2006.01)

(52) U.S. Cl.
CPC ..... *E21B 33/085* (2013.01); *E21B 33/08* (2013.01)

(58) Field of Classification Search
CPC ..... E21B 33/085; E21B 33/08
USPC ..... 166/84.3, 84.4
See application file for complete search history.

(56) References Cited

U.S. PATENT DOCUMENTS 4,154,448 A 5/1979 Biffle
4,157,186 A 6/1979 Murray
4,304,310 A * 12/1981 Garrett ..... 175/195
4,363,357 A 12/1982 Hunter
5,647,444 A 7/1997 Williams
5,662,181 A 9/1997 Williams et al.
6,244,359 B1 6/2001 Bridges et al.
2003/0056992 A1 * 3/2003 Looper ..... 175/195
2009/0161997 A1 * 6/2009 Beauchamp et al. ..... 384/15

FOREIGN PATENT DOCUMENTS

DE 2845183 A1 4/1979
GB 2394741 A 5/2004
GB 2443561 A 5/2008

OTHER PUBLICATIONS

International Search Report of PCT/CA2009/000835 mailed Jan. 12, 2010: 1-3.
Examination Report issued in CA application 2765724 on Aug. 26, 2015, 3 pages.

* cited by examiner

*Primary Examiner* — Robert E Fuller

(57) ABSTRACT

A rotating flow head has a lubricated bearing pack for isolating bearing elements from wellbore fluids under pressure. The bearing pack, having a rotating cylindrical sleeve, bearing elements and two seal assemblies, is secured within an assembly bore of a stationary housing by a retainer plate accepting a plurality of lag bolts circumferentially spaced around a top portion of the stationary housing. Each of the seal assemblies have at least one sealing element having a body, an annular cavity, an inner sealing surface, and a flange that distends radially outwardly when axially compressed. A loading ring fit to the annular cavity urges the inner sealing surface radially inwardly to sealingly engage the rotating cylindrical sleeve. The inner sealing surface further comprises a first and second sealing surface and a debris channel therebetween.

16 Claims, 23 Drawing Sheets

UNIVERSAL ROTATING FLOW HEAD HAVING A MODULAR LUBRICATED BEARING PACK

FIELD OF THE INVENTION

Embodiments of the invention relate to rotating control devices for well operations and more particularly to a modular assembly having bearings, sealing assemblies and a rotatable quill, the modular assembly being removeably secured within a stationary housing.

BACKGROUND OF THE INVENTION

In the oil and gas industry it is conventional to directly or indirectly mount a rotating control device on the top of a wellhead or a blowout preventer (BOP) stack, which may include an annular blowout preventer. The rotating control device serves multiple purposes including sealing off tubulars moving in an out of a wellbore and accommodating rotation of the same. Tubulars can include a kelly, pipe or other drill string components. The rotating control device is an apparatus used for well operations and diverts fluids such as drilling mud, surface injected air or gas and produced wellbore fluids, including hydrocarbons, into a recirculating or pressure recovery mud system. Typical in-service time numbers in the tens to low hundreds of hours before some part of the operation requires service or other attention including drill bit replacement or other downhole equipment such as motors, turbines and measurement while drilling systems. It is desirable that a rotating control device last as long as other components and not be the reason operations are interrupted and result in non-productive time (NPT).

As disclosed in U.S. Pat. No. 5,662,181 to Williams et al. and U.S. Pat. No. 6,244,359 to Bridges et al., a variety of means are provided to lubricate the bearing assembly of a rotating flow head. Conventionally, most lubrication means require that a lubricant be injected or pumped into an annulus which houses the bearings to lubricate the bearings. Such lubrication means may require elaborate hydraulic mechanisms and seal arrangements to ensure adequate lubrication and cooling of the bearings. Typically, bearing assemblies are secured within the rotating flow head by means of clamps which may increase the structural height of the rotating flow head.

If the ability to maintain adequate lubrication of the bearings is compromised, the bearings will fail quickly resulting in NPT.

One of the most common sources of premature failure of bearings in current rotating control device technology is the failure of a seal or seal stack that isolates the wellbore environment from entering the bearing assembly housing.

Reducing operational NPT by maximizing the longevity of the bearings is a key objective for all companies involved in the provision of rotating control device equipment.

There is a need for structurally low profiled rotating control device which is simple and effective that maximizes the sealing function of the bearings, and prevents premature wear and failure of the rotating control device.

SUMMARY OF THE INVENTION

A rotating flow head of the present invention comprises a lubricated seal system to improve the longevity of the rotating flow head bearings and sealing elements, and a unique assembly for providing a structurally low profile rotating flow head.

Aspects of the present invention provide a user-friendly device and contribute to significant increases in the mean time between failures in a difficult environment, known in the industry to number only in the hundreds of hours before expensive servicing is required.

A rotating flow head housing is secured to a wellhead and has an assembly bore in communication with a wellbore. The assembly bore is replaceably fit with a lubricated bearing pack for rotatably sealing tubulars extending therethrough. The bearing pack has a bearing pack housing and an axially rotatable inner cylindrical sleeve or quill adapted for the passage of drill string tubulars forming an annular bearing assembly space therebetween. Bearing elements are positioned in the annular assembly space for radially and axially supporting the inner cylindrical sleeve within the bearing pack housing and two or more sealing elements and a stripper element seal the bearing elements from wellbore fluids, In one aspect, to maximize seal life and minimize rotational drag, each of the two or more sealing elements has an elastomeric body operable between a first non-activated state and a second activated state. When activated, the elastomeric body of each sealing ring engages the quill for sealing thereto. The elastomeric body further has an annular cavity, an inner surface adapted to engage the quill, and a radially outwardly extending member supported in the bearing pack housing.

When the elastomeric body is in its first non-activated state, the radially outwardly extending member has a first radial extent being less than the radial extent of the bearing assembly space, forming a radial seal clearance; and when the elastomeric body is in its second activated state, the radially outwardly extending member is axially compressed, distending radially outwardly and substantially freely into the radial seal clearance and avoiding a jamming of the seal against the quill.

In another aspect, the axial bearings and the radial bearings are provided in pairs, the pair of radial bearings being fit to the annular assembly space with axial clearance to avoid introducing complex loading and the pair of axial bearings being fit to the annular assembly space with radial clearance to avoid complex loading.

In another aspect, the bearing pack is retained within the rotating flow head housing a retainer plate removeably secured over an installed bearing pack in the annular assembly space using a plurality of circumferentially spaced lag bolts engaged radially through the housing.

In another aspect, a portion of the quill adjacent the sealing elements is fit with sacrificial replaceable wear sleeves so as to enable periodic replacement without need to replace the quill itself.

In another aspect, and being cognizant of large and opposing pressure differentials during operations, the two or more seal elements between the bearings and the wellbore have at least one seal element oriented for sealing against wellbore fluid ingress from the wellbore to the bearings and at least seal element for sealing against egress of bearing lubricants from the bearings to the wellbore.

DETAILED DESCRIPTION OF THE PREFERRED EMBODIMENTS

A rotating flow head (RFH), more commonly known as a rotating control device, generally comprises a stationary housing adapted for incorporation onto a wellhead and a rotating cylindrical sleeve, such as a quill or mandrel, for establishing a seal to a movable tubular such as tubing, drill pipe or kelly. The quill is rotatably and axially supported by a lubricated bearing pack comprising bearing elements and seal assemblies for isolating the bearing elements from pressurized wellbore fluids.

Figure 1A:
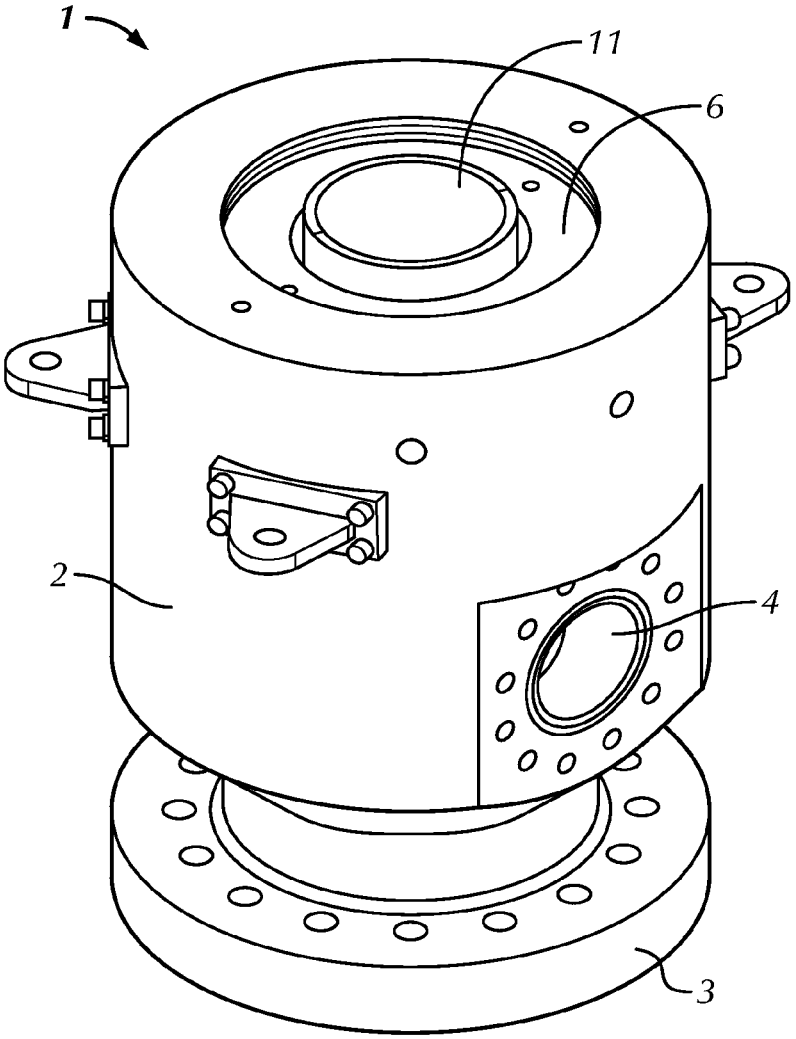
FIG. 1A is a perspective view of an embodiment of the present invention illustrating various external components.
Figure 1B:
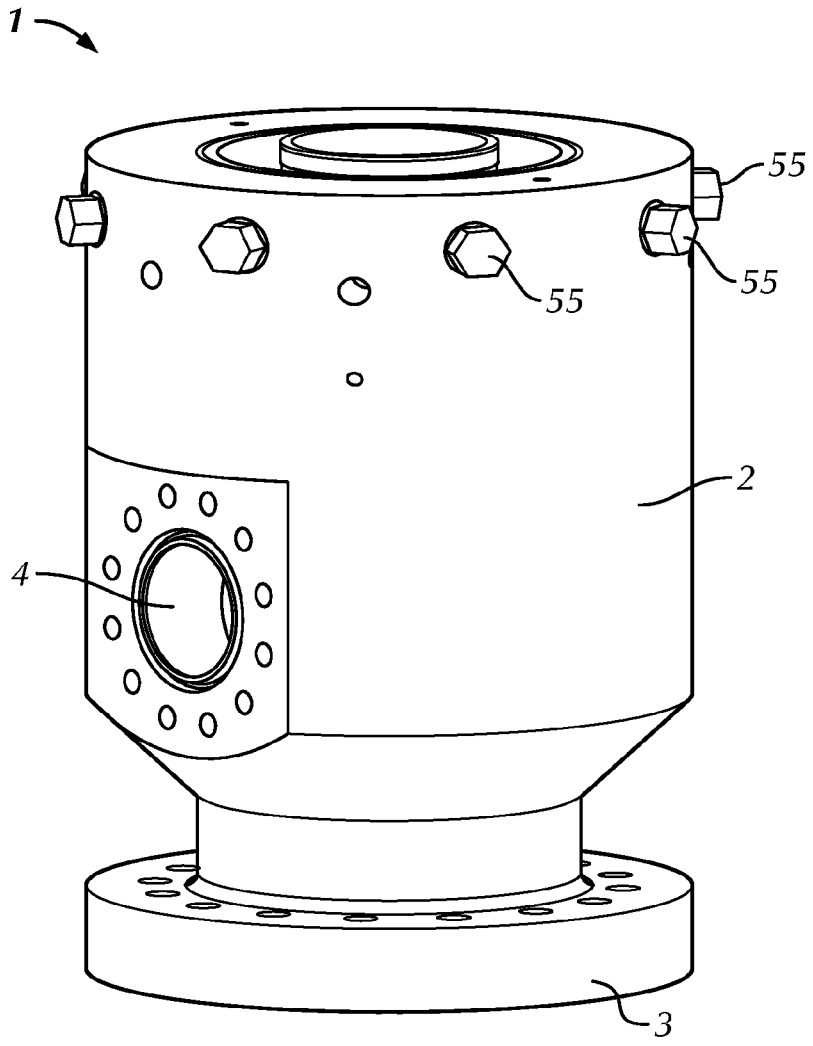
FIG. 1B is a perspective view of another embodiment of the present invention illustrating the use of lag bolts to secure a bearing pack within a stationary housing.

More specifically, as shown in FIGS. 1A and 1B, a rotating flow head 1 comprises a stationary housing 2 adapted at a lower end by a flange connection 3, to operatively connect to a wellhead or a blow out preventer (not shown). In operation for diverting and recovering fluids from the wellbore, the stationary housing 2 can be fit with one or more outlets 4 along a side portion of the stationary housing 2 for the discharge of wellbore fluids.

Figure 2:
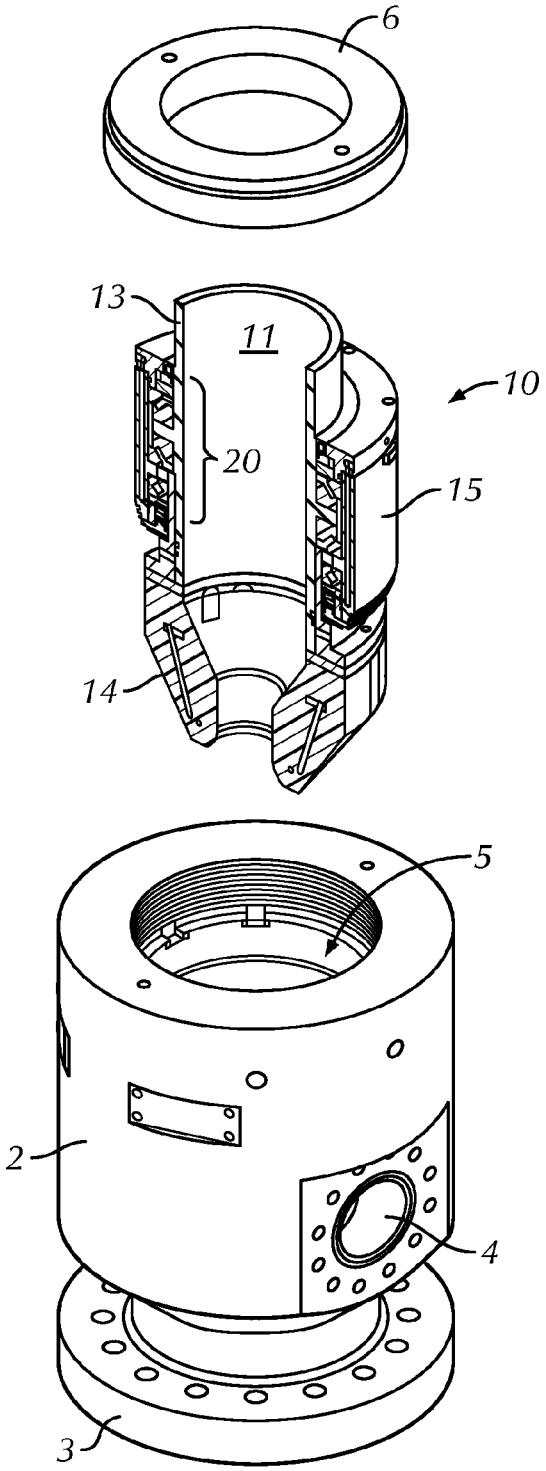
FIG. 2 is an exploded view of FIG. 1 illustrating the internal bearing and stripper assembly.

With reference to FIG. 2, the stationary housing 2 has an assembly bore 5 fit with a modular internal assembly 10 which includes a quill 11 and a bearing pack 20 having seals. The quill 11 comprises a tubular quill shaft 13 having an elastomeric stripper element 14 supported at a downhole end of the tubular shaft 13. The elastomeric stripper element 14 is adapted to seal to tubulars passing therethrough. An annular space is formed between the stationary housing 2 and the quill shaft 13. The bearing pack 20 is positioned in the annular space for axially and rotationally supporting the quill 11 in the stationary housing 2.

Downhole axial loads are borne by the transfer of loads from the quill to the bearing pack 20 and to a shoulder 17 (shown in FIG. 4A) in the stationary housing 2. Once the bearing pack 20 is installed, uphole loads are borne by the transfer of loads from the quill to the bearing pack 20 and to a retainer plate 6 removeably secured within the assembly bore 5 of the stationary housing 2.

The retainer plate 6 can be a threaded screw cap, as shown in FIG. 2 or, as shown in FIG. 1B, can comprise a thrust plate 50 secured by a plurality lag bolts 55 distributed or circumferentially spaced about an upper end of the stationary housing 2. The thrust plate 50 reduces the overall structural height of the rotating flow head 1. The low structural profile of the rotating flow head 1 allows for greater freedom and ease of movement underneath a rotary table.

The lag bolts 55 are manually or hydraulically adjustable radially inward and have a distal end 56 which impinges on the assembly bore 5 of the stationary housing 2 and retain the thrust plate 50 or adjustable radially outward to release the thrust plate 50 for removal and removal of the bearing pack 20.

Typical well operations may involve the passing of tubulars through a rotary table having a bore of about 17.5 inches in diameter. Preferably, in an embodiment of the present invention, in order to pass through a working bore of a rotary table, the thrust plate 50 should have a diameter no greater than 17.5 inches. Alternatively, the thrust plate 50 may be of a split design, comprising multiple pieces, such as two halves, which can be installed about the tubular to secure the internal assembly 10 within the assembly bore 5 of the stationary housing 2. This obviates the need to pass a retainer plate 6 through the working bore of the rotary table.

Figure 3A:
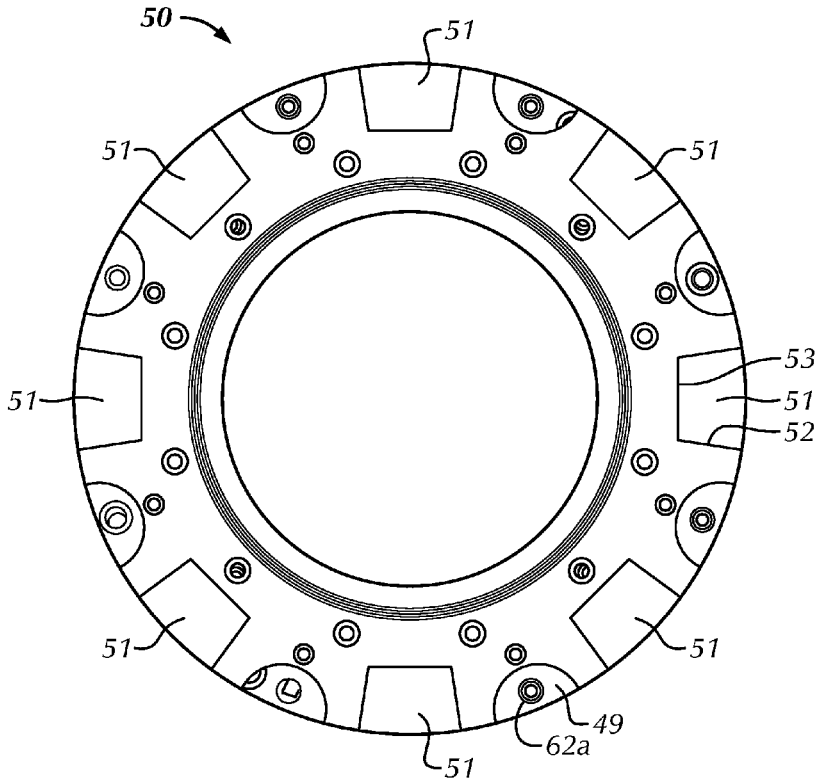
FIG. 3A is an overhead view of a thrust plate use in an embodiment of the present invention
Figure 3B:
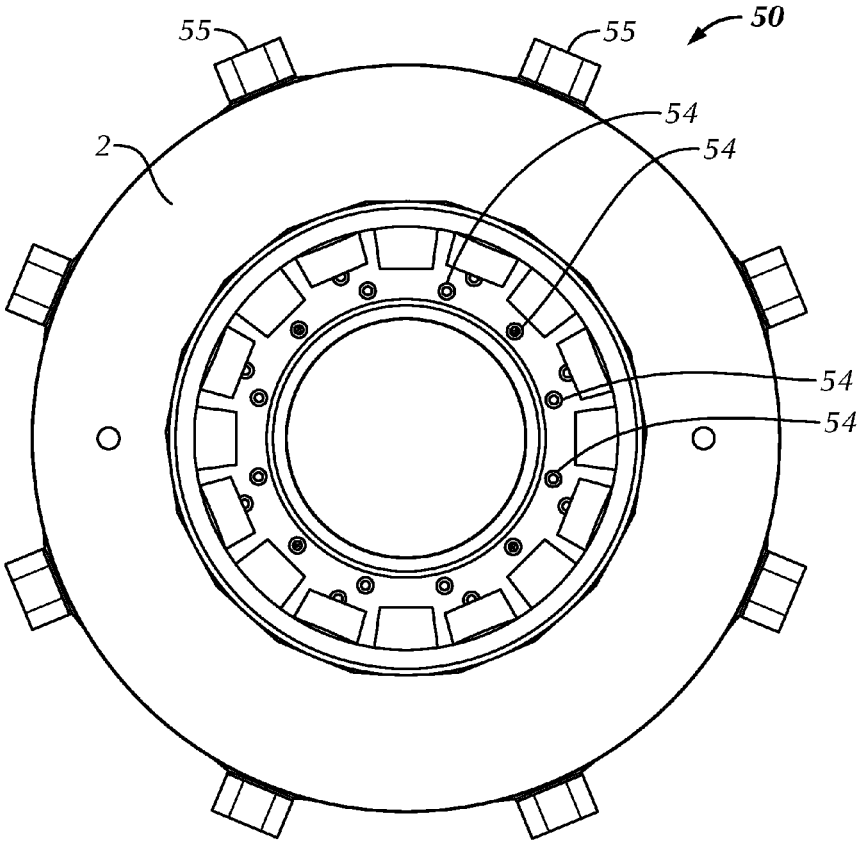
FIG. 3B is an overhead view of the thrust plate in accordance with FIG. 3A, secured by lag bolts within a stationary housing.

As shown in FIGS. 3A and 3B, a thrust plate 50 comprises a cylindrical ring, sized to fit within the assembly bore 5. The lag bolts 55 are manually or hydraulically actuated to engage the thrust plate 50 to secure the bearing pack 20 within the assembly bore 5. The thrust plate 50 may have a plurality of mating surfaces 51, on an upper surface of the thrust plate, which may be indentations, spaced circumferentially thereabout and which correspond to the distal ends 56 of each of the lag bolts 55. The distal ends 56 can be tapered so that when they engage the mating surfaces Si, the lag bolts impose an axial load onto the thrust plate 50, securing; the trust plate 50 in firm, dimensional relation to the stationary housing 2 and the bearing pack 20. Further, each of the mating surfaces 51 can comprise a single semi-spherical side wall 52 and a terminating back wall 53. In alternate embodiments the mating surfaces 51 can comprise a plurality of side walls. The thrust plate 50 can also be rotationally restrained or even attached to the bearing pack 20 such as by set screws 54.

Figure 3C:
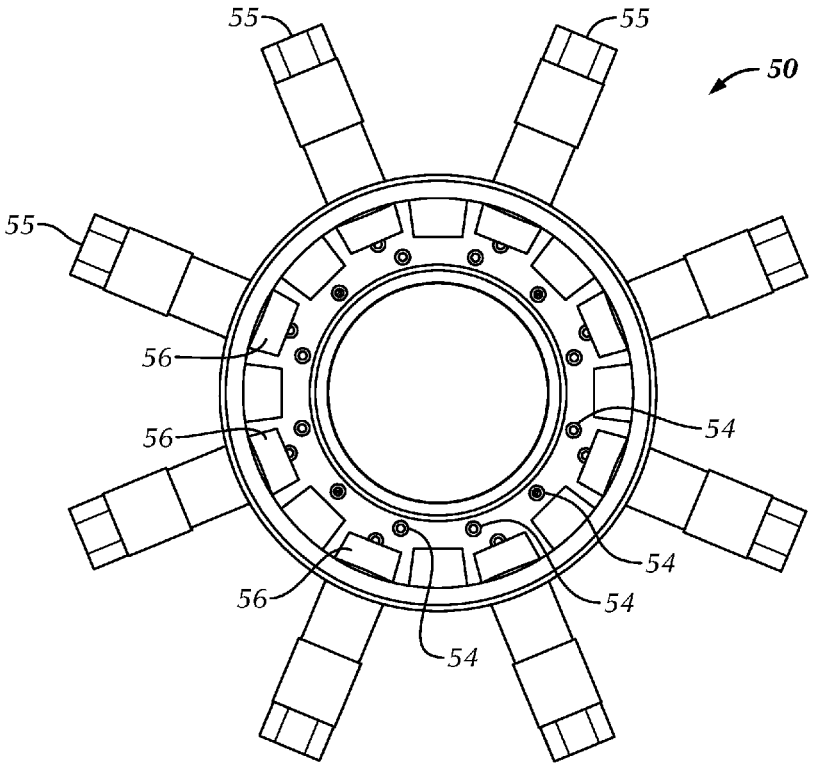
FIG. 3C is an overhead view of the thrust plate in accordance with FIG. 3A, secured in position with lag bolts (stationary housing not shown)

As shown in FIGS. 3B and 3C, the plurality of circumferentially spaced mating surfaces 51 accept the lag bolts 55, which can be manually or hydraulically actuated through the stationary housing 2, for securing the internal assembly 10 within the assembly bore 5 of the stationary housing 2. In addition, by restraining the bearing pack rotationally to the thrust plate 50 and the accepting of the lag bolts 55 within the mating surfaces 51 also prevent rotational movement of the bearing pack 20 relative to the stationary housing 2.

Figure 4A:
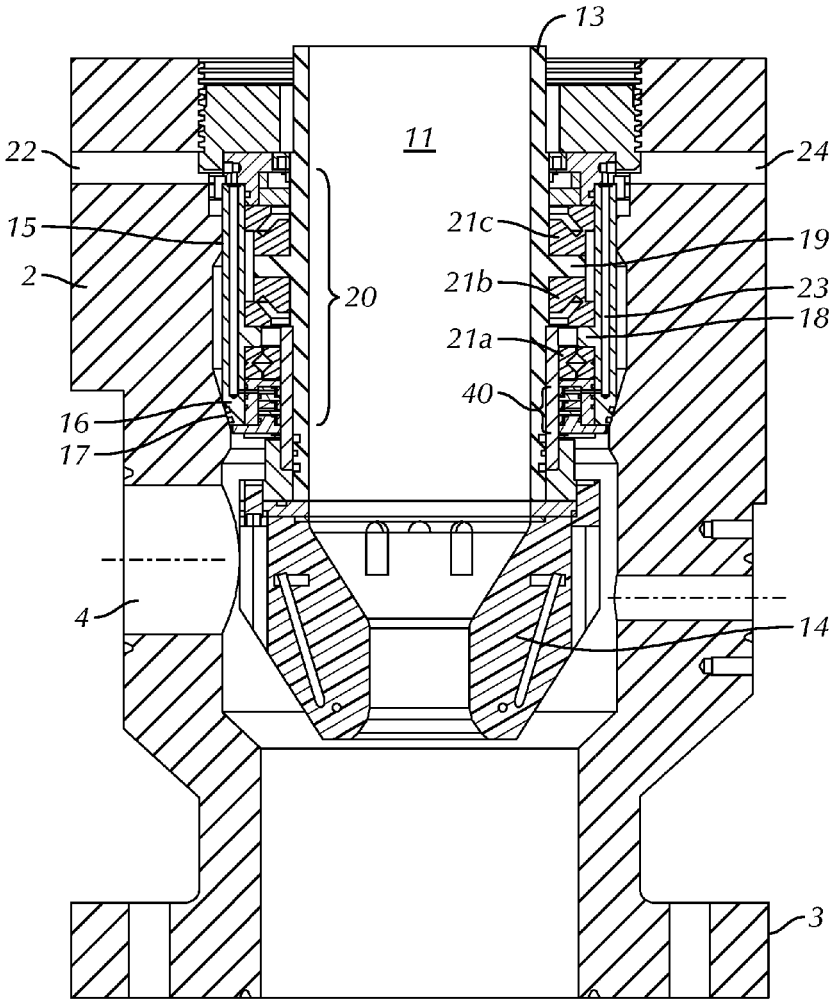
FIG. 4A is a cross-sectional view of an embodiment of the present invention illustrating an internal assembly positioned within a stationary housing, illustrating the bearing and sealing elements, and lubricant passageways.
Figure 4B:
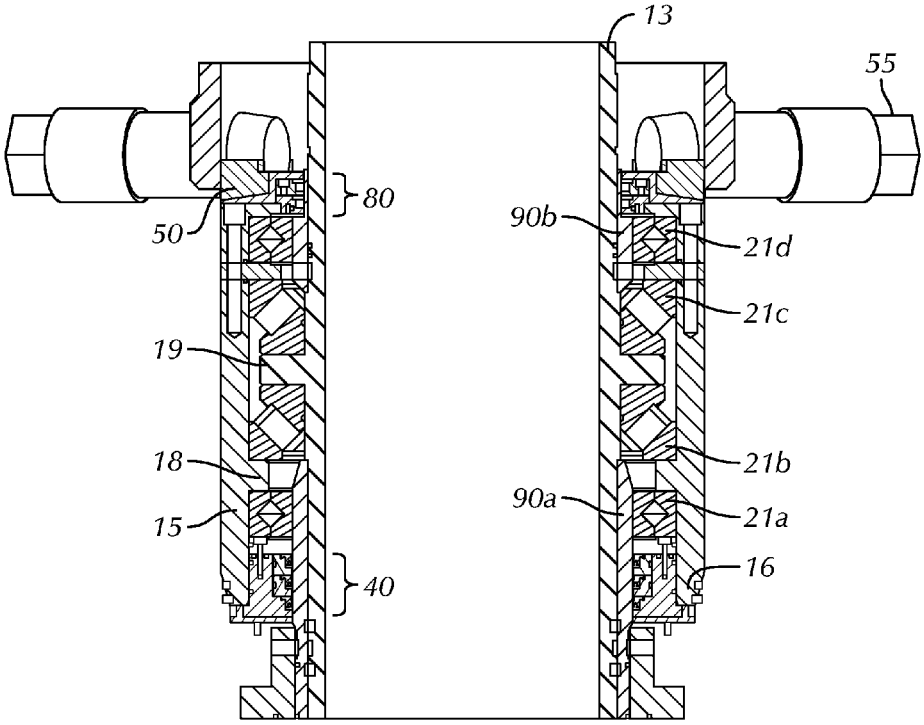
FIG. 4B is a cross-sectional view of another embodiment of the present invention illustrating lag bolts securing a thrust plate to retain an internal assembly; the internal assembly illustrates an embodiment having four bearing elements and two seal assemblies.

Referring back to FIG. 2, the bearing pack 20, can be releaseably fit as a module or internal assembly 10 into the assembly bore 5 of the stationary housing 2. As shown in FIGS. 4A and 4B, the internal assembly 10 comprises an outer bearing housing 15 having bearings 21, a lower seal assembly 40 having at least two sealing elements, and an upper seal assembly 80 having at least one sealing element, for replacement as a single unit or module. The outer bearing housing 15 may have a tapered lower end 16 which is supported upon the shoulder 17 in the assembly bore 5 of the stationary housing 2 and retained therein by the retainer plate 6.

As shown in FIG. 4A, the outer bearing housing 15 has a radially inward shoulder 18 and the quill shaft 13 has a radially outward shoulder 19 which cooperate with the bearing pack 20 to axially and rotationally support the quill 11 in the outer bearing housing 15. The stripper element elastomeric is attached to a downhole portion of the quill shaft 13.

In another embodiment, as shown in FIG. 4B, adjacent the seal assemblies 40, 80, the quill shaft 13 is fit with sacrificial replaceable quill wear sleeves 90*a*, 90*b*. A downhole sacrificial quill wear sleeve 90*a* envelopes that portion of the quill shaft 13 that engages the lower seal assembly 40 and bearing element 21*a*. An uphole sacrificial replaceable quill wear sleeve 90*b* envelopes that portion of the quill shaft 13 that engages the upper seal assembly 80 and bearing element 21*d*.

The sacrificial quill wear sleeves 90*a*, 90*b* can be readily available on site and are easily replaceable once worn due to prolonged operations. Instead of having to replace an entire rotating quill 11, a quick replacement of the sacrificial quill wear sleeves 90*a*, 90*b* reduces nonproductive time and thus saves operational time and costs.

Figure 5A:
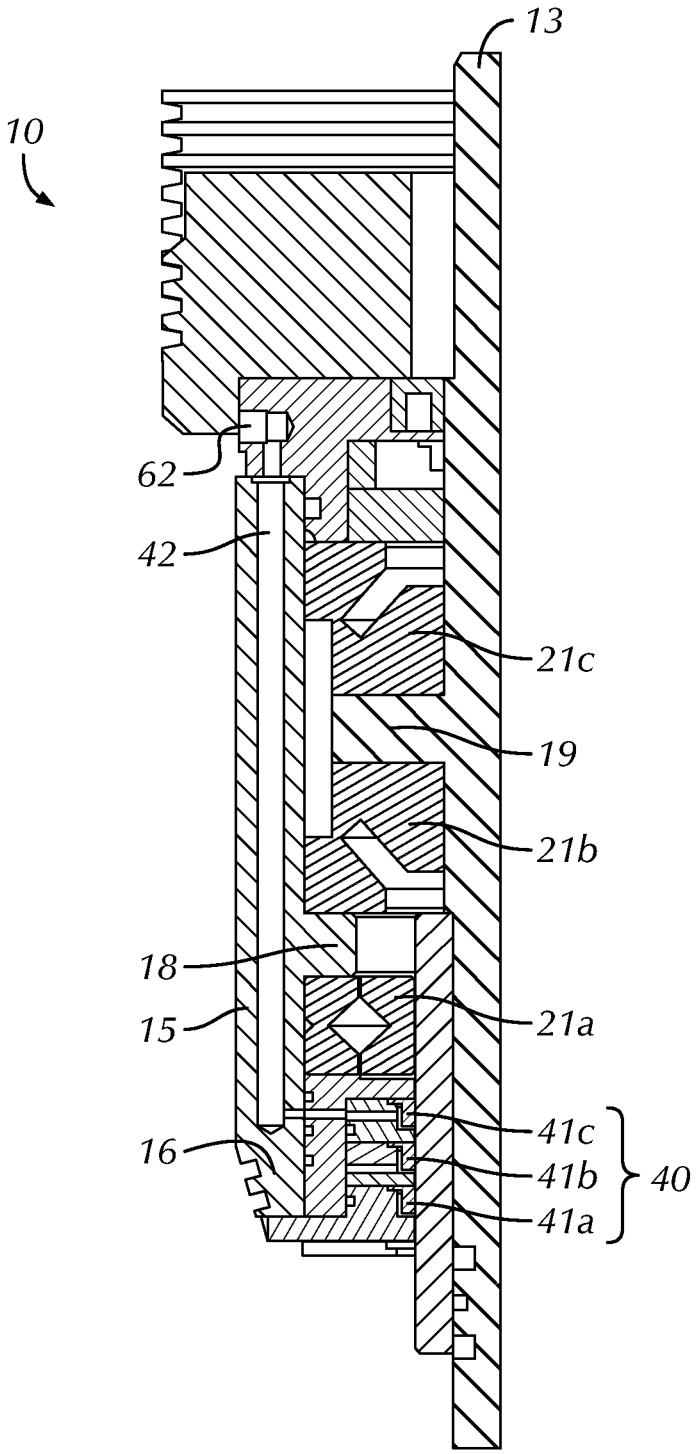
FIG. 5A is an enlarged view of a one-half section of the sealed bearing pack of FIG. 4A further illustrating the individual sealing elements, and individual bearing elements.
Figure 5B:
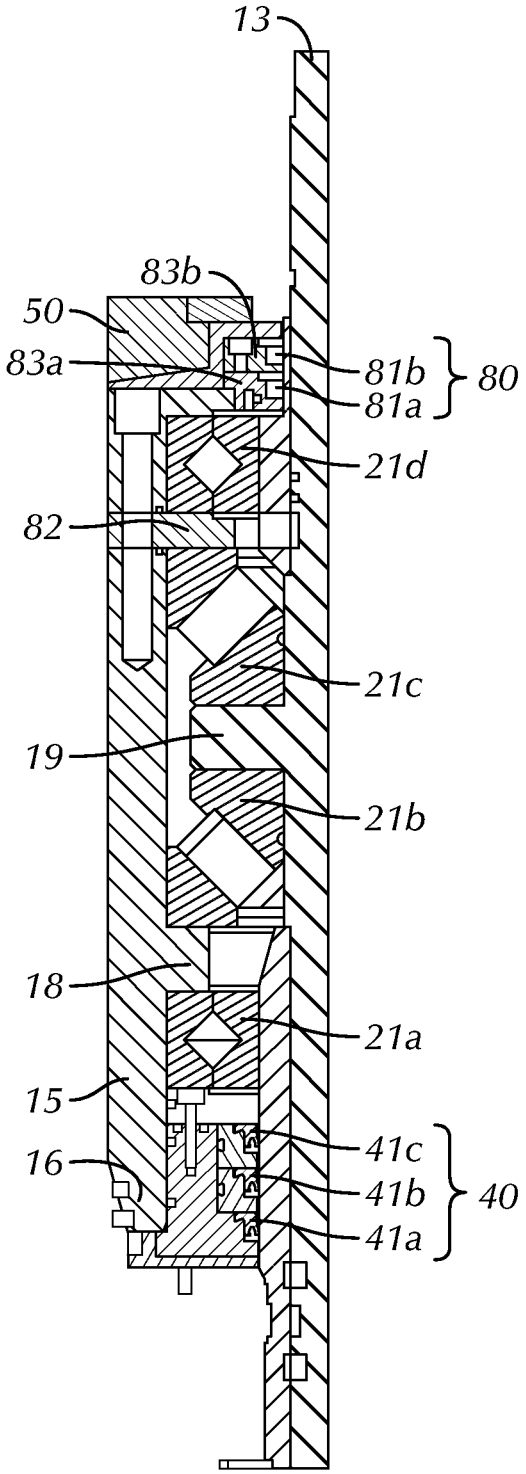
FIG. 5B is an enlarged view of a one-half section of the sealed bearing pack of FIG. 4B further illustrating the individual sealing elements, and individual bearing elements.

With reference to FIGS. 5A and 5B, the outer bearing housing 15 and the quill shaft 13 define an annular assembly space therebetween for supporting bearing elements 21*a*, 21*b*, 21*c*, 21*d* and seal assemblies 40, 80. The quill shaft 13 is axially and radially supported within the outer bearing housing 15 by bearing elements 21*a*, 21*b*, 21*c*, 21*d*. Lower seal assembly 40 is located downhole from the bearing elements 21*a*, 21*b*, 21*c*, 21*d*, while upper seal assembly 80 is located uphole of the bearing elements 21*a*, 21*b*, 21*c*, 21*d*.

With reference to FIG. 5A, the outer bearing housing 15 houses bearing elements 21*a*, 21*b*, 21*c* and lower seal assembly 40. Lower seal assembly 40 isolates wellbore fluids from the bearings elements 21*a*, 21*b*, 21*c*. The lower seal assembly 40 can comprise one or more seal elements 41*a*, 41*b*, 41*c*. The bearing elements 21*a*, 21*b*, 21*c* are selected from heavy duty bearings for rotationally and axially supporting loads resulting from wellbore pressure and tubular movement. The bearing elements 21*a*, 21*b*, 21*c* handle radial loads, downhole loading and uphole loading respectively. The bearing elements 21*a*, 21*b*, 21*c* between the outer bearing housing 15 and the quill shaft 13 are provided with a first lubricant which can be circulated for cooling the bearings and surrounding area.

In an alternate embodiment, as shown in FIG. 5B, the axial bearings and the radial bearings are provided in pairs, a pair of radial bearings being fit to the annular assembly space with axial clearance to avoid introducing complex loading and a pair of axial bearings being fit to the annular assembly space with radial clearance to avoid complex loading. Accordingly, the internal assembly 10 houses a fourth bearing element 21*d*, for handing radial loading, and a second upper seal assembly 80. Upper seal assembly 80 can comprise two sealing elements 81*a*, 81*b*, which aid lower seal assembly 40 with sealing wellbore fluids from the bearing elements 21*a*, 21*b*, 21*c*, 21*d*.

Sealing elements 81*a*, 81*b* are the same as sealing elements 41*a*, 41*b*, 41*c*, except for being smaller in dimensions.

Bearing elements 21*a* and 21*d*, such as cross roller bearings, radially support the quill 11. Bearing elements 21*b* and 21*c*, such as thrust bearings, axially support the quill 11.

To prolong the life expectancy of the bearing elements 21*a*, 21*b*, 21*c*, 21*d*, the radial movement of the quill 11 has been isolated from the axially movement of the quill 11. The axial tolerances above and below radial load bearing elements 21*a* and 21*d* are provided to allow axial movement of bearing elements 21*a* and 21*d*. Further, the radial tolerances adjacent axial load bearing elements 21*b* and 21*c* are also provided, allowing for radial movement of bearing elements 21*b* and 21*c*. An isolation thrust plate 82 between cross roller bearing element 21*d* and thrust bearing element 21*c* also aids in isolating the axial movement of the quill 11 from the radial movement.

In one embodiment, the bearing elements 21*a*, 21*b*, 21*c*, 21*d*, are in fluid communication with a bearing lubricant passageway 23 (shown in FIG. 6) for directing a bearing lubricant under pressure to the bearing elements 21*a*, 21*b*, 21*c*, 21*d*. The bearing lubricant passageway 23 forms a discrete and independent bearing fluid system. The bearing lubricant, stored on the surface in a bearing lubrication tank, can be continuously flushed through the bearing fluid system to lubricate and cool the bearing elements 21*a*, 21*b*, 21*c*, 21*d*. In another embodiment, a heat exchanger can be provided to provide extra cooling of the bearing lubricant.

Figure 7A:
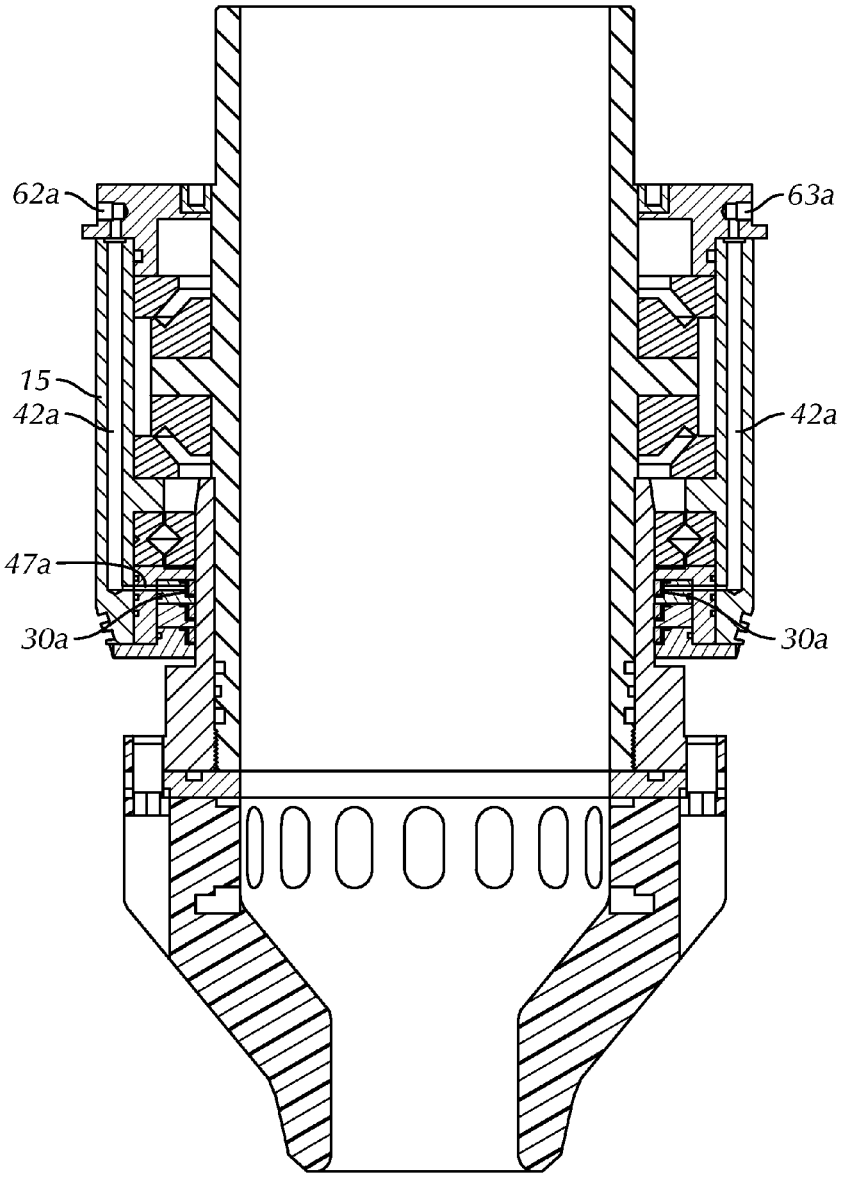
FIG. 7A is a cross sectional view of an embodiment of the present invention showing the internal assembly including a bearing housing, seal assembly and stripper element, illustrating a lubricant passageway in fluid communication with a seal interface between the upper and intermediate sealing elements.
Figure 7B:
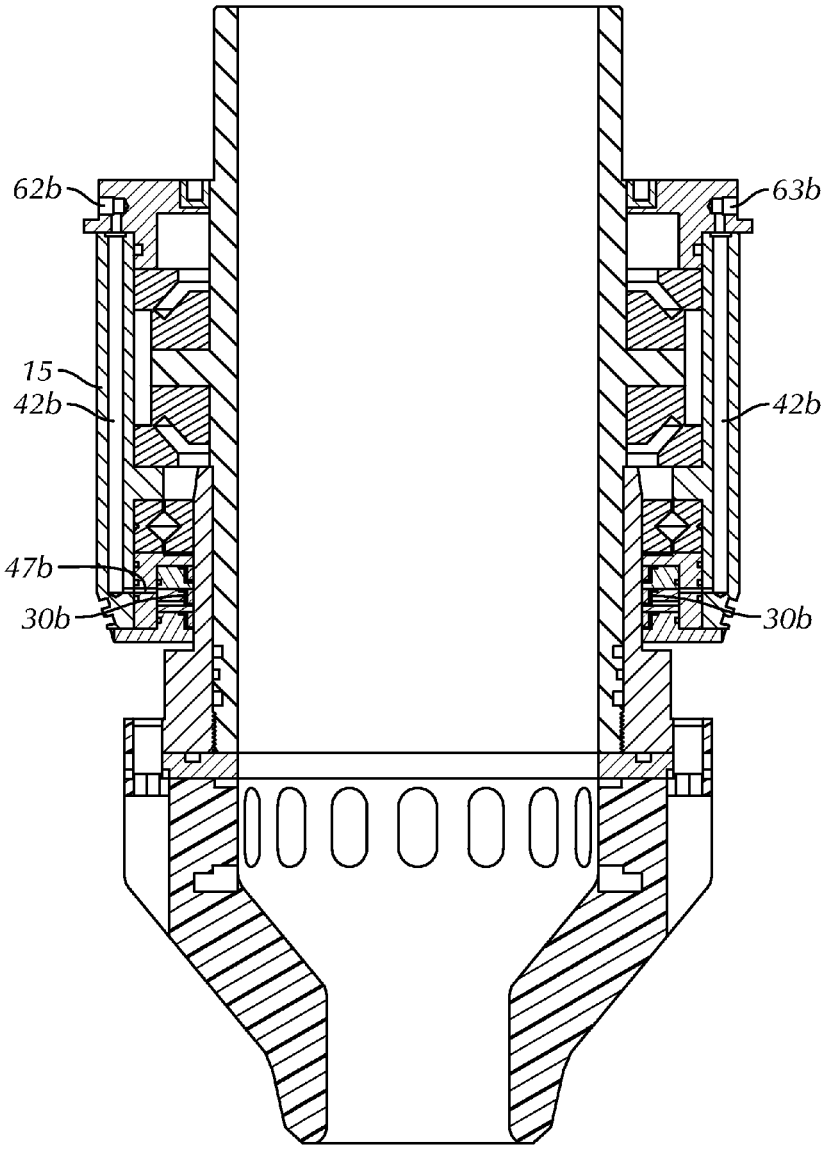
FIG. 7B is a cross sectional view of an embodiment of the present invention showing the internal assembly including a bearing housing, seal assembly and stripper element, illustrating a lubricant passageway in fluid communication with a seal interface between the intermediate and lower sealing elements.
Figure 12:
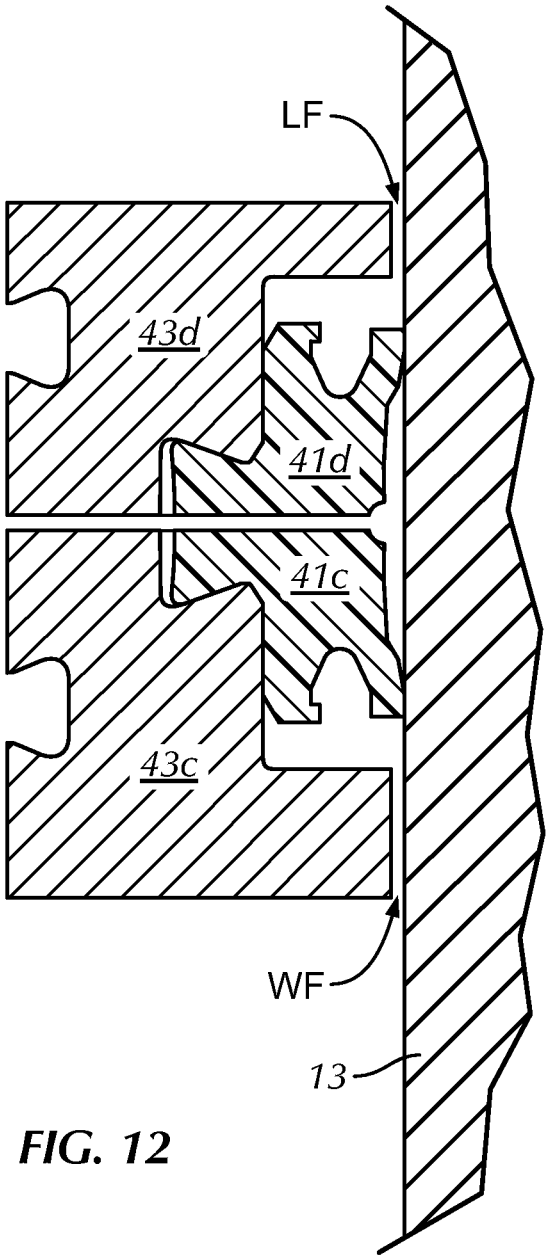
FIG. 12 is a side view of an embodiment of the present invention illustrating at least one sealing element oriented for sealing against wellbore fluid ingress from the wellbore to the bearings and the at least one sealing element for sealing against the egress of pressurized bearing lubricants from the bearings to the wellbore.
Figure 13:
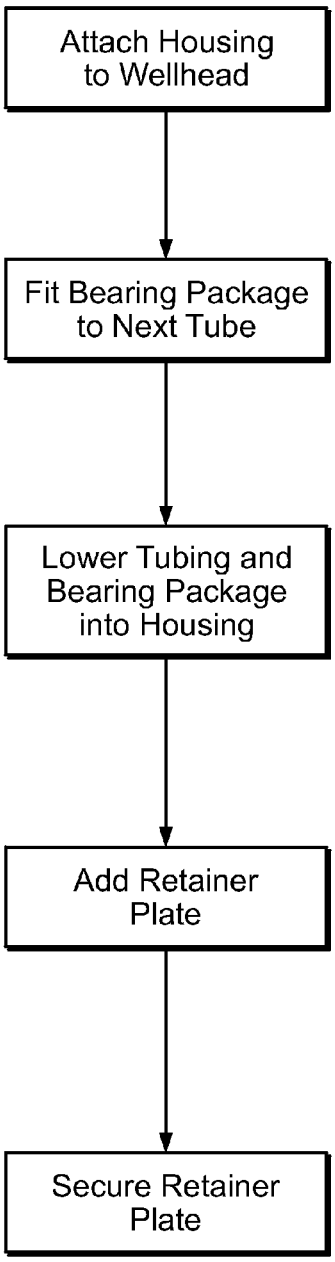
FIG. 13 is a diagrammatical representation of a method of employing an embodiment of the present invention.
Figure 14A:
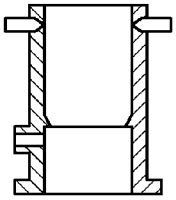
FIGS. 14A-14E are schematic representations of the steps of the method in accordance to FIG. 13.
Figure 14B:
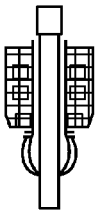
Figure 14C:
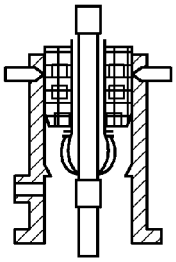
Figure 14D:
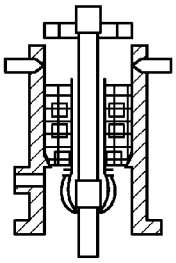
Figure 14E:
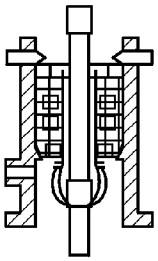

In the embodiment shown in FIGS. 7A, and 7B, the lower seal assembly 40 can comprise three sealing elements 41*a*, 41*b*, 41*c* which isolates the bearing elements 21*a*, 21*b*, 21*c* from wellbore fluids. During operations, the wellbore pressure can be very high, threatening the integrity of the sealed bearings. Alternatively, the pressure in the wellbore could drop below some maintenance pressure of the bearings lubricant, threatening loss of lubricant to the wellbore. Accordingly, in an alternate embodiment, and cognizant of these large and opposing pressure differentials during operations, the lower seal assembly 40, between the bearings and the wellbore, have at least one sealing element 41*d* oriented for sealing against wellbore fluid ingress WF from the wellbore to the bearings and the at least one sealing element 41*d* for sealing against the egress LF of pressurized bearing lubricants from the bearings to the wellbore (see FIG. 12). The at least one sealing element 41*d* is supported within the lower seal assembly 40 by seal carrier 43*d*.

The longevity of the lower seal assembly 40 may be further increased using at least a seal lubricant directed to the lower seal assembly 40. In another embodiment, the seal lubricant can be under pressure. The lower seal assembly 40 is in fluid communication with a seal lubricant passageway 42 for directing the seal lubricant under pressure to the lower seal assembly 40 to form a seal fluid system which is a discrete and independent from the bearing lubricant passageway 23. The seal lubricant, stored on the surface in a separate seal lubricant tank, can be continuously or periodically flushed to lubricate and remove accumulated debris and/or air from within the lower seal assembly 40.

In an embodiment, the seal lubricant and the bearing lubricant are different lubricants and have separate storage tanks on the surface. The seal lubricant tank can be smaller than the bearing lubricant tank to allow ease of replacing used lubricant with fresh lubricant. In embodiments where the seal and bearing lubricants are the same, the lubricant can be stored in the same tank. However, a separate smaller sacrificial tank can be used to isolate used lubricant circulated from the sealing elements.

Generally, a seal lubricant inlet port 62*a*, 62*b* is in fluid communication with a seal lubricant passageway 42*a*, 42*b* in the outer bearing housing 15 for access to the annular bearing assembly space. An outlet port (not shown) positioned about diametrically opposite to the inlet port 62*a*, 62*b* to enable outflow of the seal lubricant. Seal lubricant passageways 42*a*, 42*b* are formed in the outer bearing housing 15 for directing a seal lubricant to one or more axial locations along the annular assembly space, such as to the one or more of the sealing elements 41*a*, 41*b*, 41*c*.

In one embodiment, the seal lubricant inlet port 62*a*, 62*b* can be a top entry lubrication port as opposed to a side entry lubrication port illustrated in FIGS. 7A and 7B. With reference to also FIG. 3A, the thrust plate 50 can be fit with recesses 49 for enabling and connection to top entry lubrication ports 62*a*.

In another embodiment, the seal lubricant may be pressurized sufficiently to introduce the seal lubricant to the lubricant passageways 42 to create a pressurized seal lubricant circuit. A pressurized seal lubricant circuit would be formed for each of the sealing elements 41*a*, 41*b*, 41*c* and can be individually monitored, manually or remotely, by known methods in the art for sudden increases in pressure, indicating seal failure.

Figure 8A:
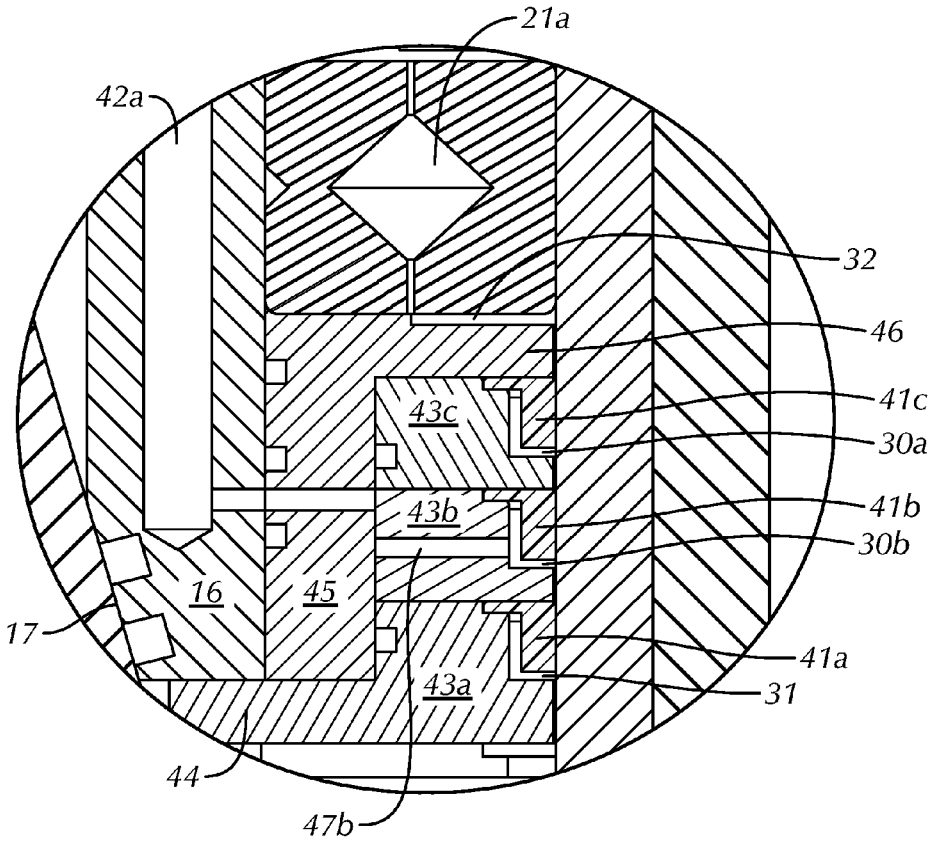
FIG. 8A is a cross sectional view of an embodiment of the present invention illustrating a lubricant passageway in fluid communication with the seal interface between an upper and intermediate sealing elements of the seal assembly.
Figure 8B:
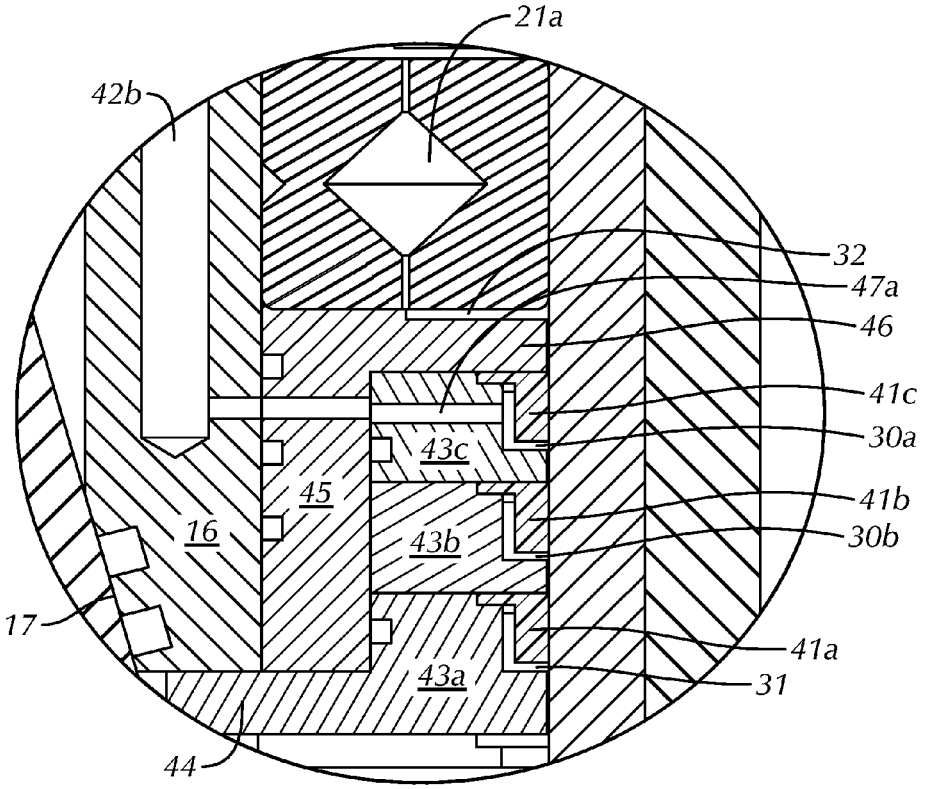
FIG. 8B is a cross sectional view of an embodiment of the present invention illustrating a lubricant passageway in fluid communication with the seal interface of an upper sealing element of the seal assembly.

As best seen in FIGS. 8A and 8B, in one embodiment, the lower seal assembly 40 has three elastomeric sealing elements 41*a*, 41*b*, 41*c*. Each elastomeric sealing element 41*a*, 41*b*, 41*c* is supported by a corresponding seal carrier 43*a*, 43*b*, 43*c* which are in turn supported in the outer bearing housing 15. The seal carrier 43*a* of the lowermost sealing element 41*a* can be formed by ring 44 which further assists in retaining all the seal carriers 43*a*, 43*b*, 43*c* and sealing elements 41*a*, 41*b* and 41*c* within the lower end tapered of the outer bearing housing.

Lower seal assembly 40 is supported within a seal sleeve 45, an upper end of the seal sleeve having a radially inward shoulder 46 bearing against the lower bearing element 21*c*. The seal sleeve 45 has a lower end supported in the outer bearing housing 15 by the seal retaining ring 44. The sealing elements 41*a*, 41*b*, 41*c* are sandwiched between the upper radially inward shoulder 46 and the seal retaining ring 44 therebelow.

In another embodiment, the radially inward shoulder 46 of the seal sleeve 45 is replaced with an additional sealing element. This additional sealing element can be an inverted sealing element, such as a bi-directional seal or wiper seal. This bi-directional seal seals against the downhole movement of lubricants from within the annular assembly space when there is zero wellbore pressure, and also seals against uphole movement of wellbore fluids when the wellbore fluids are pressurized.

The lower sealing element 41*a* is supported in a seal carrier 43*a*. The lower sealing element 41*a* has an uphole surface that seals against a second seal carrier 43*b*. The second sealing element 41*b* is supported in the second seal carrier 43*b* and the uppermost sealing element 41*c* is supported in a third seal carrier 43*c*. The uppermost sealing element 41*c* has an uphole surface that seals against the radially inward shoulder 46 of the seal sleeve 45.

A first sealing interface 30*a* is formed between an uphole surface of the lowermost sealing element 41*a* and a downhole surface of the second seal carrier 43*b* of the second sealing element 41*b*. A first lubricant passageway 42*a*, in the outer bearing housing 15, is in fluid communication with the first sealing interface 30*a*. The second seal carrier 43*b* can be fit with a connecting passageway 47*a* which extends additionally through the seal sleeve 45, for directing a seal lubricant from the fluid passageway 42*a* to the first sealing interface 30*a*.

Accordingly, when the seal lubricant enters the first seal interface 30*a*, the seal lubricant applies a pressure between the first and second sealing elements 41*a*, 41*b*. The pressure between the first and second sealing elements 41*a*, 41*b* can be monitored for a sudden increase in pressure. A sudden increase in pressure would generally be a result of the failure of the first seal 41*a* and the fluid communication of the first seal interface 30*a* with pressurized wellbore fluids.

In an embodiment having three sealing elements, as shown in FIG. 7B, a second sealing interface 30*b* is formed between second and third sealing elements 41*b*, 41*c*. A second seal lubricant passageway 42*b* is in fluid communication with the second sealing interface 30*b*. Seal carrier 43*c* is fit with a connecting passageway 47*b* in fluid communication with the second lubricant passageway 42*b* through the seal sleeve 45, for directing seal lubricant under pressure to the second sealing interface 30*b*.

Similar to the first seal interface 30*a*, the pressure between the second and third sealing elements 41*b*, 41*c* can be monitored for a sudden increase in pressure. A sudden increase in pressure would generally be a result of the failure of the second seal 41*b* and the fluid communication of the second seal interface 30*b* with pressurized wellbore fluids.

Optionally, continuous or periodic flushing of the sealing interfaces 30*a* and 30*b*, removes any accumulated debris and/or air from the seal interfaces 30*a*, 30*b*. In embodiments of the invention, the first and second lubricant passageways 42*a*, 42*b* can be maintained independent from each other and may be energized with different fluid pressures. In other embodiments, the first and second lubricant passageways 42*a*, 42*b* can be fluidly coupled and be energized with the same fluid pressure.

A downhole surface of the lowermost sealing element 41*a* forms a wellbore interface 31 against the wellbore fluids.

Referring back to FIGS. 6, 7A and 7B, generally, the bearing interface 32 and seal interfaces 30*a*, 30*b* are shown to be in fluid communication with their own corresponding lubricant passageways 23, 42*a*, and 42*b*. For example, in the embodiment shown in FIG. 6, the bearing interface 32 is in fluid communication with bearing lubricant passageway 23. In FIG. 7A, the seal lubricant passageways 42*a* are in fluid communication with seal interface 30*a*, and similarly in FIG. 7B, lubricant passageways 42*b* are in fluid communication with seal interface 30*b*.

The bearing lubricant passageways 23 are provided with an inlet port 60 and an outlet port 61 while the seal lubricant passageways 42*a*, 42*b* are provided with an inlet port 62*a*, 62*b* and an outlet port 63*a*, 63*b* to enable independent flows of the bearing and seal lubricants. In alternate embodiments, the inlet and outlet ports for the bearing lubricant and seal lubricant can be from a top of the bearing pack 20.

Seal lubricant passageways 42*a*, 42*b* for each seal interface 30*a*, 30*b* are in fluid communication with their own corresponding connecting passageway 47*a*, 47*b* (FIGS. 7A and 7B), allowing for independent control over each seal interface 30*a*, 30*b*.

Figure 6:
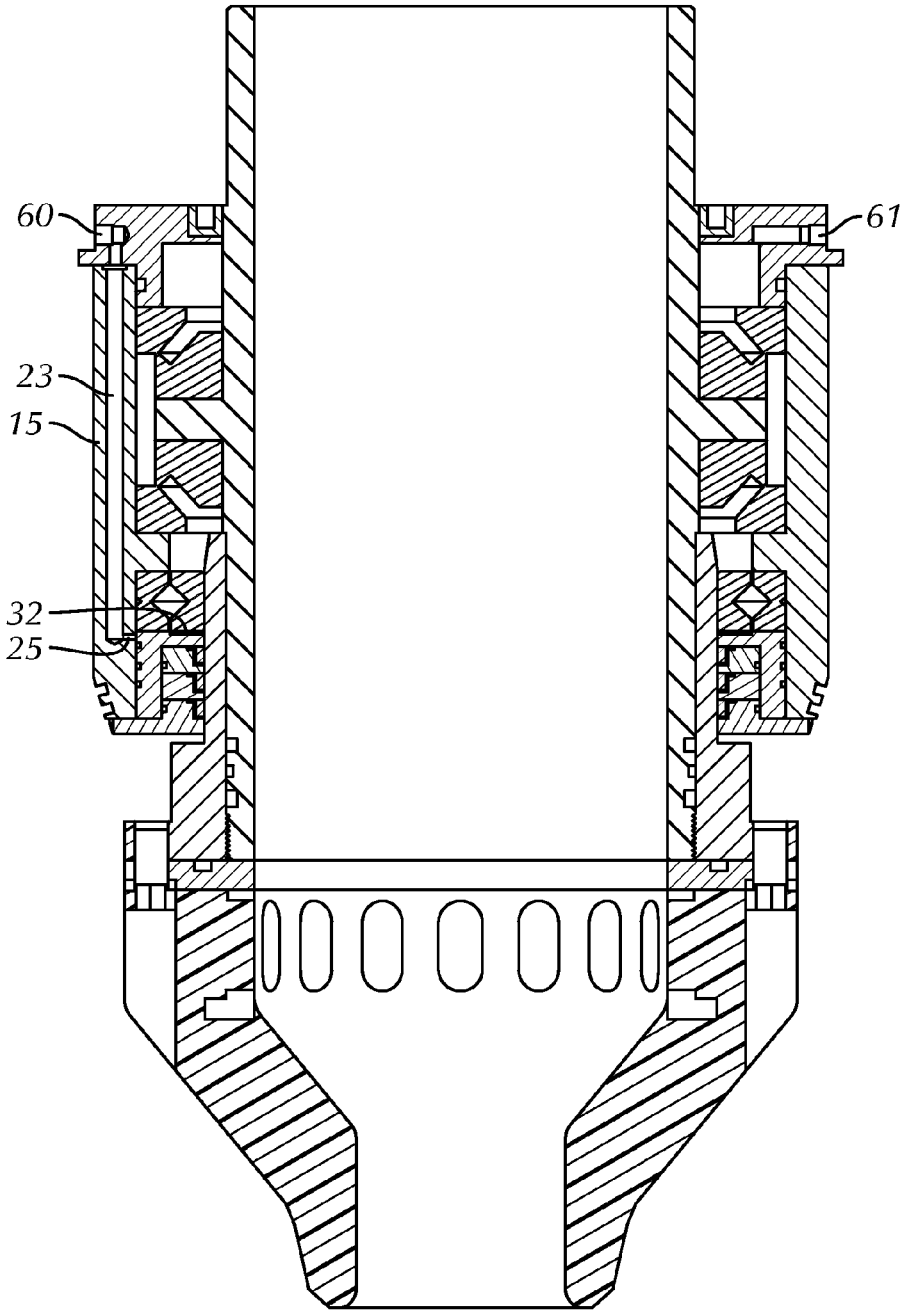
FIG. 6 is a cross sectional view of an embodiment of the present invention showing the internal assembly including a bearing housing, seal assembly and stripper element, illustrating a bearing lubricant passageway in fluid communication with a bearing interface.

For example, as shown in FIG. 6, the bearing lubricant passageway 23 is in fluid communication with bearing interface 32 via a bearing connecting passageway 25. The bearing lubricant passageway 23 is in fluid communication with a corresponding inlet port 60 and a corresponding outlet port 61, forming a discrete fluid system that is independent of other fluid systems.

Similarly, as shown in FIG. 7A, lubricant passageway 42*a*, in fluid communication with seal interface 30*a* via the connecting passageway 47*a*, is in fluid communication with its corresponding inlet port 62*a* and outlet port 63*a*, forming another discrete and independent fluid system.

FIG. 7B illustrates another discrete and independent fluid system with lubricant passageway way 42*b* in fluid communication with seal interface 30*b* via connecting passageway 47*b*. Similar to the above fluid systems, lubricant passageway 42*b* is also in fluid communication with a corresponding inlet port 62*b* and outlet port 63*b*.

In another embodiment, the lubricant passageways 42*a*, 42*b* can be a common annular passageway, formed in the outer bearing housing, allowing for common control of the seal interfaces 30*a*, 30*b*.

In one embodiment, a seal lubricant is directed to each of the seal interfaces 30*a*, 30*b* at a pressure that is appropriate for the operational conditions observed for that particular wellhead operations. The seal lubricant can be charged to an appropriate pressure, which can be greater than or lower than the pressure of the wellbore fluids. The seal lubricant under pressure can be used to monitor seal integrity. The seal lubricant can be continuously or periodically flushed within the seal interfaces 30*a*, 30*b*.

If the operational conditions warrant a continuous flushing of the seal lubricant, a pump can be fluidly connect corresponding inlets and outlets to a seal lubricant reservoir. If continuous flushing is not necessary, and periodic flushing of the seal lubricant is sufficient, displacement of the used seal lubricant can be accomplished with a simple hand pump to provide sufficient force to eject used lubricant and inject fresh lubricant to the seal interfaces 30*a*, 30*b*. For these purposes, a single port can be used to both introduce clean seal lubricant and release used seal lubricant.

Further still, in another embodiment, a circulation pump can be operatively connected to the corresponding inlet and outlet of the bearing elements 21*a*, 21*b*, 21*c* to form a closed loop circulation system for continuously flowing lubricant through the bearing elements 21*a*, 21*b*, 21*c*. The flowing lubricant cools and lubricates the bearing elements 21*a*, 21*b*, 21*c*. Cooling of the bearing elements 21*a*, 21*b*, 21*c* provides a general cooling effect to the surrounding structure which is beneficial to other components such as the sealing elements 41*a*, 41*b*, 41*c*.

The independency of the bearing and seal interfaces with each other and the independency of their corresponding lubricant passageway allows for differing conditions to be maintained across each interface, allowing for an operator to select the optimal levels of lubricant pressure across each sealing element and the circulating rate of the lubricant for each seal interface to achieve longer sealing element life.

Further still, in extreme conditions, such as operations in geothermal wells, the stationary housing 2 can be adapted to include a water jacket to aid in cooling the bearing pack 20.

Figure 9A:
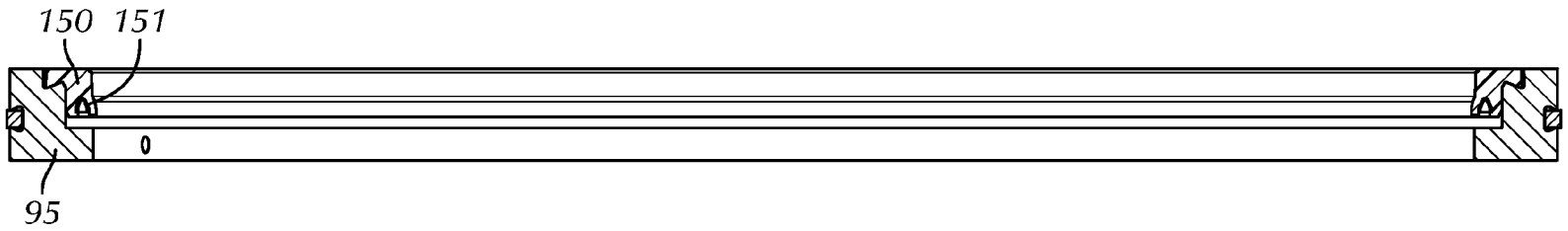
FIG. 9A is a side cross-sectional view of a two-part sealing element in accordance with the present invention.
Figure 9B:
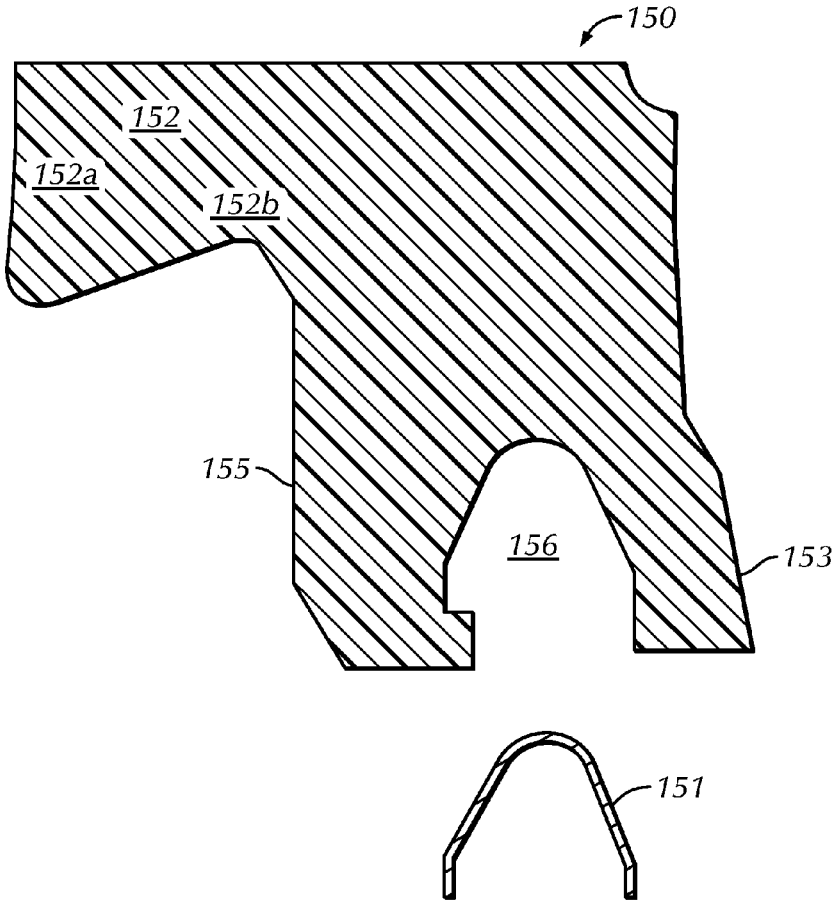
FIGS. 9B and 9C are partial, exploded views of a cross-section of the sealing element of FIG. 9A illustrating the sealing element body and loader ring.
Figure 9C:
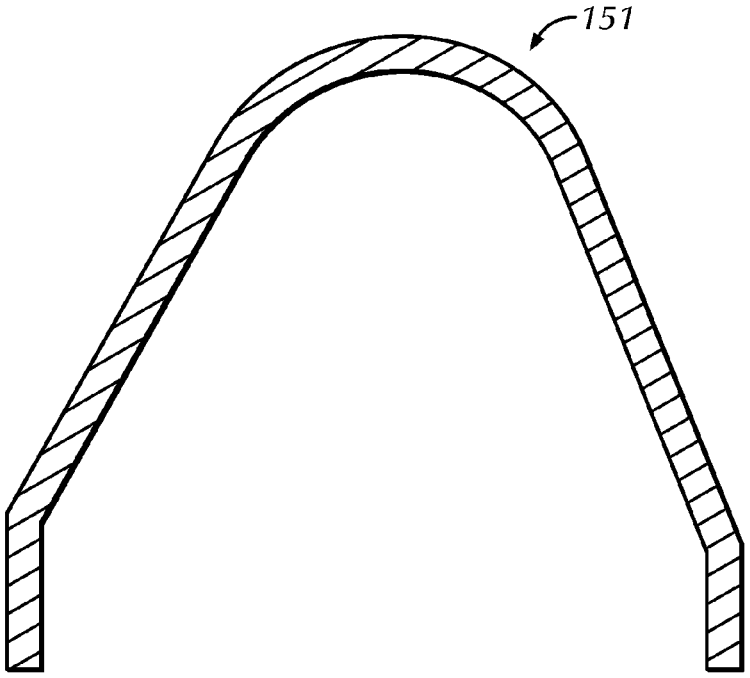

With reference to FIGS. 9A, 9B, and 9C, an exemplary sealing element is an elastomeric seal, such as a two part, U-cup seal, designed by the Applicant and commissioned for manufacture by SKF USA. Each sealing element 41 *a*, 41 *b*, 41 *c*, 81 *a* 81 *b*remains stationary, supported in the outer bearing housing 15 by corresponding seal carriers 43*a*, 43*b*, 43*c*, 83*a*, 83*b* which are in turn supported by the stationary housing 2 while maintaining a seal against the quill shaft 13.

As shown, this two part multi-lip seal used for seal elements 41*a*, 41*b*, 41*c*, 81*a*, and 81*b* comprises a body 150 and a loading ring 151. The body 150 comprises an outer peripheral wall 155, having a flange 152, an annular cavity 156, and an inner sealing surface 153 adapted to engage the quill shaft 13. The outer peripheral wall 155 is supported in the outer bearing housing 15. The flange 152, having a one-half of a dovetail profile, is tapered radially, its distal end 152*a* having a greater axial depth than its proximal end 152*b*.

Figure 10:
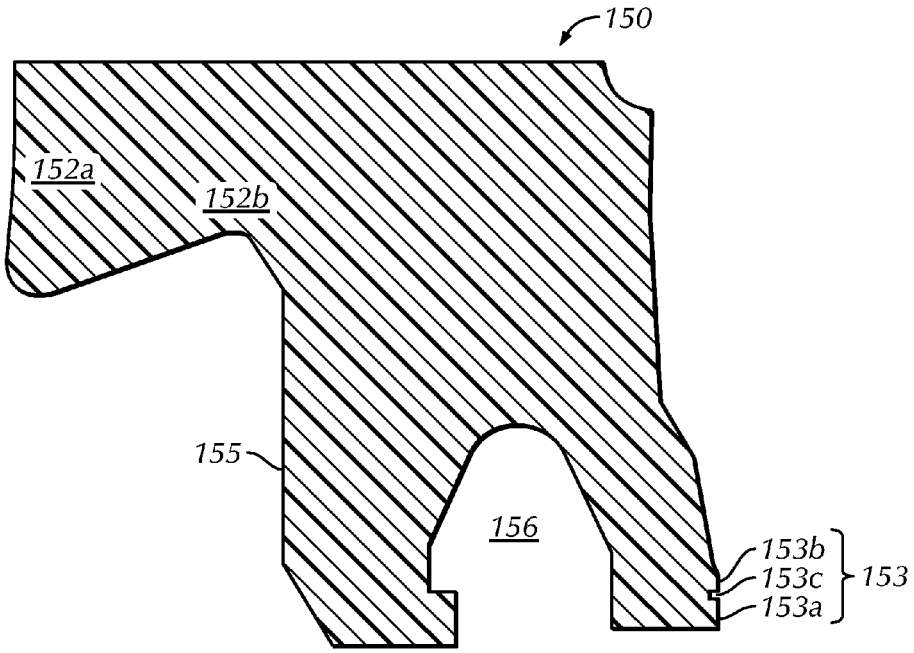
FIG. 10 is an exploded view of the inner sealing surface of the two-part sealing element in accordance to FIG. 9A, illustrating a first and second sealing surface and a circumferential groove or debris channel.

As shown in FIG. 10, the inner sealing surface 153 illustrated for sealing against the quill shaft 13 comprises a lower sealing surface 153*a*, an upper sealing surface 153*b* and a sealing channel 153*c* therebetween. Applicant believes that the sealing channel 153*c* provides an area to capture and retain any debris that can result from wearing of the lower sealing surface 153*a*. The captured debris will be isolated within the sealing channel 153*c* and will not interfere with the upper sealing surface 153*b*, prolonging the life of the upper sealing surface 153*b*, and thus increasing the life expectancy of the sealing element.

The loading ring 151 has a greater cross-sectional width than that of the annular cavity 156. The loading ring 151 fits within the annular cavity 156, applying a radial force to urge the inner sealing surface 153 to expand radially inwardly to sealingly engage the quill shaft 13. The loading ring 151 provides a radially inwardly force against the inner sealing surface 153 urging the inner sealing surface 153 to displace radially inwardly.

The body 150 can be composed of carbon fibre filled modified polytetrafluoroethylene (PTFE). The loading ring 151 can be of a springy metallic material, such as hardened cobalt-chromium-nickel alloy, more commonly known as elgiloy. The loading ring 151 provides a consistent radially inwardly force sufficient to urge the inner sealing surface 153 of the body 150 to seal against the quill shaft 13 while prolonging the life of the sealing element.

Figure 11A:
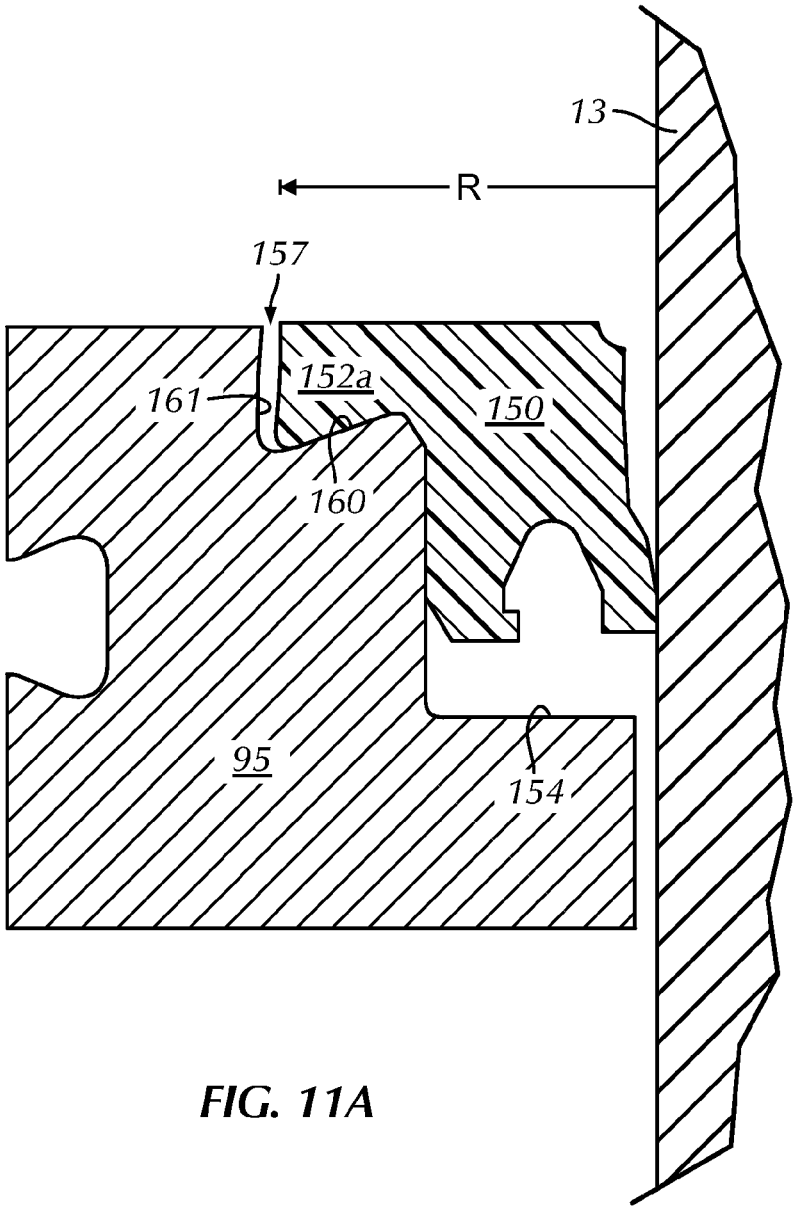
FIGS. 11A and 11B are cross sectional views of an embodiment of the present invention illustrating how the sealing element, when axially compressed, distends radially outwardly towards a seal carrier, and into a seal gland.
Figure 11B:
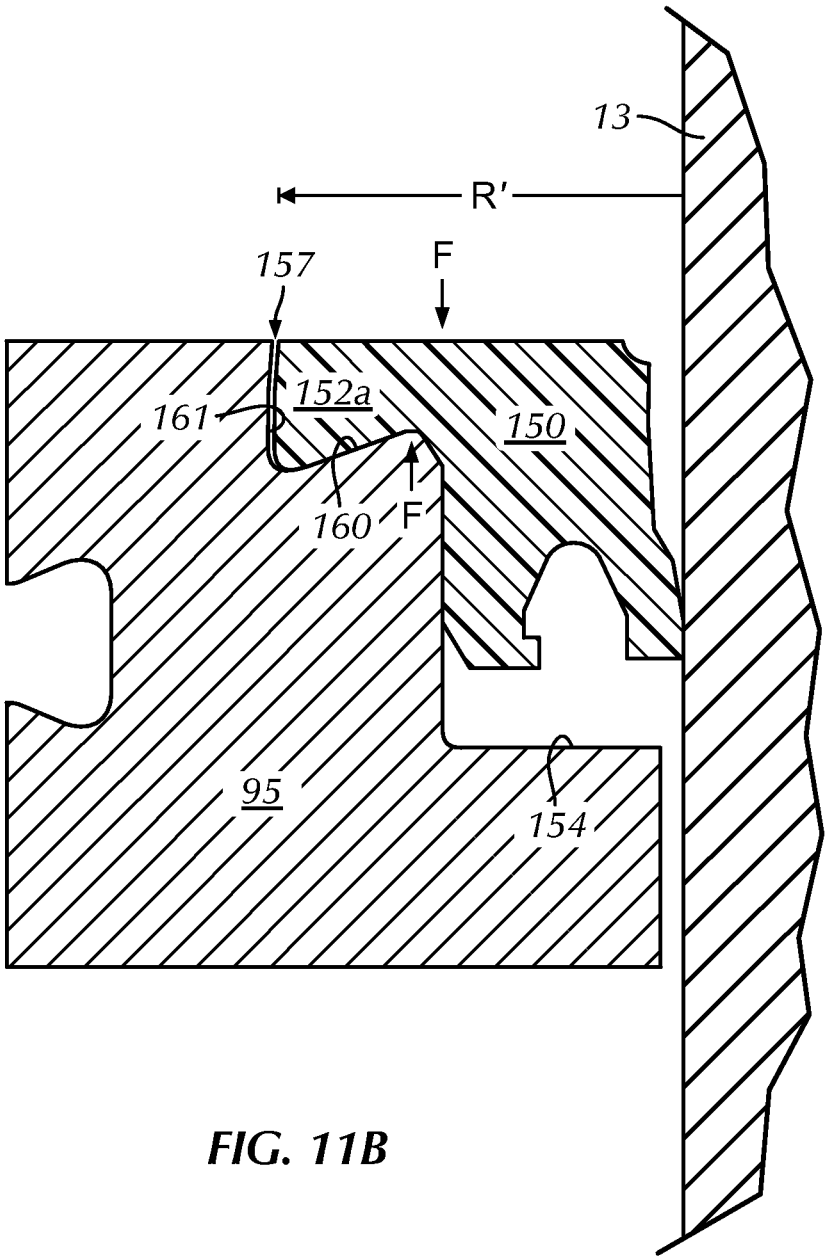

With references to FIGS. 11A and 11B, a sealing element, is supported by a seal carrier 95. The inner sealing surface 153 of the sealing element engages the quill shaft 13. The seal carrier 95 is profiled to fit the sealing element and comprises an interface surface 154, a complementary radially tapered surface 160 and a back wall 161. A bottom end of the sealing element, in conjunction with the interface surface 154 of the seal carrier, together form seal interfaces 30*a*, 30*b* (also see FIGS. 7A and 7B). The flange 152 is supported on the complementary radially tapered surface 160. A seal gland 157 is formed between the distal end 152*a* of the flange 152 and the back wall 161.

The sealing element is actuable between a non-activated state and an activated state. As shown in FIG. 11A, when there is no axial compression exerting a force F on the sealing element, the sealing element is in its non-activated state. In its non-activated state, flange 152 is relaxed and has a radial extent R that does not distend into the seal gland 157.

As shown in FIG. 11B, when there is an axial compressive force F exerted, flange 152 radially distends, urging distal end 152*a* radially outward towards the back wall 161 of the seal carrier 95 and into the seal gland 157. The radial extent R' of flange 152, when the sealing element is activated, is greater than the radial extent R when the sealing element is not activated.

The Applicant believes that the axial compression of the sealing element, causes the radially outwardly distention of the flange 152 and does not cause the radial inward movement of the inner sealing surface 153. This radially outwardly movement of the flange 152 firmly secures the sealing element within the bearing pack 20 and at the same time does not increase the rotational drag exerted on the quill shaft 13. The Applicant believes that by allowing the flange 152 to distend radially outwardly, the inner sealing surface 153 is not crushed against the quill shaft 13 and does not contribute to rotational drag.

The Applicant believes that the radially outwardly distention of the flange 152 allows for proper activation of the sealing element under pressure and in zero pressure environments, resulting in lower break torque limits and running torque, of the quill shaft 13, and thus ensuring increased longevity of the sealing elements 41*a*, 41*b*, 41*c*, 81*a*, 81*b*.

In another embodiment, a seal interface pressure monitor (not shown) can be used to monitor the pressure at each of the seal interfaces 30*a*, 30*b*. With each successive failure of the sealing elements 41*a*, 41*b*, a corresponding increase in fluid pressure at the seal interfaces 30*a*, 30*b* should be observed, allowing an operator to identify each sealing element that has failed, and preemptively replace the bearing pack 20 before the failure of the last sealing element 41*c* and the introduction of wellbore fluids into the bearings 21, resulting in NPT.

With reference to FIG. 13 and FIGS. 14A-14E, in operation, underneath the rotary table of a drilling rig, the stationary housing is secured to a wellhead or a BOP stack above a wellhead. Above the rotary table and the drilling rig floor, the bearing pack is positioned on an intervening tubular of a tubing string. The intervening tubular with the bearing pack is lowered through a working bore of the rotary table and positioned within the assembly bore of the stationary housing. The bearing pack is then secured within the assembly bore by a retainer plate, such as a threaded screw cap or a thrust plate. Securing the retainer plate can involve simply tightening down the threaded screw cap, or can involve actuating a plurality of lag bolts circumferentially spaced along a top portion of the stationary housing, to engage the thrust plate.

The embodiments of the invention for which an exclusive property or privilege is claimed are defined as follows:

1. A modular lubricated bearing pack for a rotating control device comprising:

a bearing pack housing and a rotatable cylindrical sleeve adapted for passage of a tubular, forming an annular assembly space therebetween;

bearing elements positioned in the annular assembly space for radially and axially supporting the rotatable cylindrical sleeve within the bearing pack housing;

one or more seal assemblies, each of the one or more seal assemblies having at least one sealing element, each of the at least one sealing element further comprising, an elastomeric body operable between a first non-activated state and a second activated state, the elastomeric body having an annular cavity, an inner sealing surface adapted to engage the rotatable cylindrical sleeve, and a radially outwardly extending flange supported in the bearing pack housing; and a loading ring, fit within the annular cavity, for urging the inner sealing surface to expand radially inwardly to engage the rotatable cylindrical sleeve for sealing thereto, wherein when the elastomeric body is in the first non-activated state, the radially outwardly extending flange has a first radial extent being less than a radial extent of a space in which the elastomeric body is disposed, the first radial extent and the radial extent being measured from the rotatable cylindrical sleeve; and wherein when the elastomeric body is in the second activated state, the radially outwardly extending flange is axially compressed, distending radially towards the bearing pack housing and has a second radial extent greater than the first radial extent, the second radial extent being measured from the rotatable cylindrical sleeve; and an elastomeric stripper element for sealing the tubular against the wellbore fluids from passing thereby.

2. The modular lubricated bearing pack of claim 1, wherein the bearing elements have a first lubricant under pressure.

3. The modular lubricated bearing pack of claim 2, wherein the bearing elements are a pair of radial bearings and a pair of axial bearings.

4. The modular lubricated bearing pack of claim 3, wherein the pair of radial bearings have axial clearance and the pair of axial bearings have radial clearance.

5. The modular lubricated bearing pack of claim 2, wherein the one or more seal assemblies further comprises an upper seal assembly above the bearing elements and a lower seal assembly below the bearing elements.

6. The modular lubricated bearing pack of claim 5, wherein the rotatable cylindrical sleeve further comprises at least one upper replaceable wear sleeve adjacent the upper seal assembly and at least one lower replaceable wear sleeve adjacent the lower seal assembly.

7. The modular lubricated bearing pack of claim 5, wherein the upper seal assembly further comprises at least one upper seal element and the lower sealing assembly further comprises at least two lower sealing elements.

8. The modular lubricated bearing pack of claim 7, wherein the at least two lower sealing elements further comprise at least one bi-directional sealing element oriented to seal against the first lubricant under pressure from egressing downhole into the wellbore.

9. The modular lubricated bearing pack of claim 7, wherein the at least one sealing element further comprises a first sealing surface, a second sealing surface, and a circumferential groove therebetween.

10. The modular lubricated bearing pack of claim 1, wherein the at least one sealing element is at least two sealing elements.

11. The modular lubricated bearing pack of claim 10 wherein the at least two sealing elements form at least one seal interface therebetween and wherein a second lubricant is provided to the at least one seal interface.

12. The modular lubricated bearing pack of claim 11, further comprising at least one lubricant passageway in fluid communication between the bearing pack housing and the at least one seal interface.

13. The modular lubricated bearing pack of claim 1, wherein the radially outwardly extending flange has an axial depth greater at a distal end than at a proximal end and is supported by a corresponding profiled seal carrier.

14. A rotating control device comprising:

a stationary housing having a bore;

a modular lubricated bearing pack comprising:

a bearing pack housing and a rotatable cylindrical sleeve adapted for passage of a tubular, forming an annular assembly space therebetween;

bearing elements positioned in the annular assembly space for radially and axially supporting the rotatable cylindrical sleeve within the bearing pack housing;

one or more seal assemblies, each of the one or more seal assemblies having at least one sealing element, each of the at least one sealing element further comprising, an elastomeric body operable between a first non-activated state and a second activated state, the elastomeric body having an annular cavity, an inner sealing surface adapted to engage the rotatable cylindrical sleeve, and a radially outwardly extending flange supported in the bearing pack housing; and a loading ring, fit within the annular cavity, for urging the one or more seal assemblies to expand radially inwardly to engage the rotatable cylindrical sleeve for sealing thereto;

wherein when the elastomeric body is in the first non-activated state, the radially outwardly extending flange has a first radial extent being less than a radial extent of a space in which the elastomeric body is disposed, the first radial extent and the radial extent being measured from the rotatable cylindrical sleeve; and wherein when the elastomeric body is in the second activated state, the radially outwardly extending flange is axially compressed, distending radially towards the bearing pack housing and has a second radial extent greater than the first radial extent, the second radial extent being measured from the rotatable cylindrical sleeve; and an elastomeric stripper element for sealing the tubulars against the wellbore fluids;

a retainer plate fit to the bore and secured therein, for securing the modular lubricated bearing pack within the bore of the stationary housing; and a plurality of lag bolts circumferentially spaced around a top portion of the stationary housing and extending radially through the stationary housing into the retainer plate.

15. The rotating control device of claim 14, wherein the plurality of lag bolts have tapered ends to engage corresponding mating surfaces of the retainer plate.

16. The rotating control device of claim 14, wherein the retainer plate can fit through a working bore of a rotary table.

* * * * *